US005253464A

United States Patent [19]

Nilsen

[11] Patent Number: 5,253,464

[45] Date of Patent: Oct. 19, 1993

[54] RESILIENT SPORTS FLOOR

[75] Inventor: Bjarne Nilsen, Kristiansand S, Norway

[73] Assignee: Boen Bruk A/S, Tveit, Norway

[21] Appl. No.: 688,639

[22] Filed: Apr. 19, 1991

[30] Foreign Application Priority Data

May 2, 1990 [NO] Norway ..... 901951

[51] Int. Cl.[5] ..... E04B 5/02

[52] U.S. Cl. ..... 52/508; 52/480

[58] Field of Search ..... 52/480, 479, 481, 508; 272/3

[56] References Cited

U.S. PATENT DOCUMENTS

| | | | |
|---|---|---|---|
| 498,344 | 5/1893 | Williams | 52/508 |
| 2,862,255 | 12/1958 | Nelson | 52/480 |
| 3,579,941 | 5/1971 | Tibbals | 52/390 |
| 3,604,173 | 9/1971 | Dahlborg | 52/508 |
| 4,694,627 | 9/1987 | Omholt | 52/480 |

*Primary Examiner*—Michael Safavi

*Attorney, Agent, or Firm*—Townsend and Townsend Khourie and Crew

[57] ABSTRACT

A resilient sports floor comprising a top layer, which is designed to be a coherent sheet consisting of boards. In each board recesses are provided in the shape of mutually parallel grooves along the entire length of the board, in which grooves strips of a springy resilient material, e.g. a natural or synthetic rubber material or a porous, springy plastic material, are inserted. The thickness of strips is larger than the depth of grooves, so that the strips project below the underside of layer with their lower portion. The floor is provided with the free surface of strips directly against a rigid sub-floor. In case of extremely high loads strips will be pressed into grooves, so that the strips are relieved due to the fact that the floor is in direct contact with the sub-floor with its underside.

2 Claims, 2 Drawing Sheets

RESILIENT SPORTS FLOOR

Figure 1:
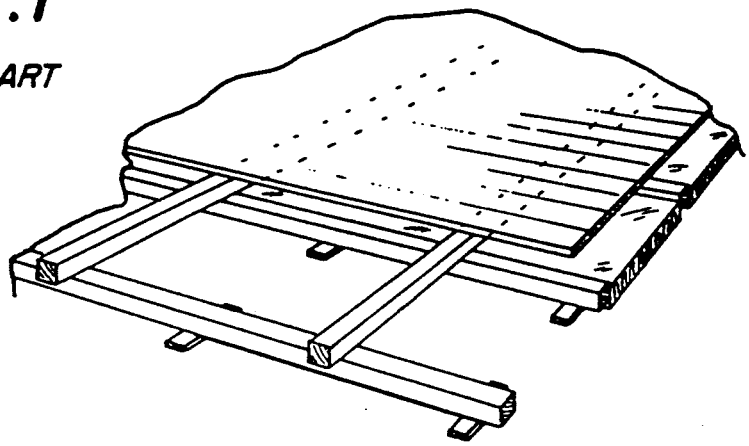
FIG.1 PRIOR ART

The present invention relates to a resilient sports floor of the kind comprising a relatively rigid upper layer, which is provided on a rigid sub-floor, e.g. a concrete support, via springy means. There are several resilient sports floors on the market. The choice of such a floor depends on the intended use (athletics), and the price which the buyer is willing to pay. The different kinds of floors may roughly be listed in three cathegories, i.e.:

1. Point resilient floors
2. Surface resilient floors
3. Combined structures

The point floor is the less expensive one of the above kinds and comprises at least one resilient, soft layer which is glued directly onto a rigid sub-floor. This floor is characterized by the fact that a point load will only deform the floor directly beneath the load surface. The disadvantage of such a floor is that it has very high friction which may cause serious injuries to the athletes, and it has poor dampening properties.

The combined structures show very good properties, but they are, on the other hand, complicated and expensive and show a large structural height.

The present invention belongs to category 2, i.e. a surface resilient floor. As mentioned above, such a floor comprises a relatively rigid upper layer, which is, via resilient means, mounted onto a rigid sub-floor, e.g. a concrete sole. A commonly used floor of this kind will appear from FIG. 1 in the drawing. This floor comprises a relatively rigid upper layer of boards glued together and resting on a rigid sub-floor by the aid of crossed joists which are supported by alignment blocks. Between joists heat or noise insulating material may be provided.

From SE Patent No. 394307 a structure is known, in which only one layer of joists is used, with joists being supported by resilient spring elements against the rigid sub-floor. The resilient spring elements consist of curved spring leaves which are provided in recesses in the lower side of the joists, so that part of the convex arch projects outside the recess. In a non-loaded state the floor, thus, rests on evenly distributed points in the shape of the curved spring leaves. When loaded, the floor will give way, and in case of a high load the spring leaves will be urged up into the recess, and the joists get in contact with the floor.

The problem with such a structure is that the floor will give way irregularly and insufficiently, its structural height will be large and the structure will be unnecessarily expensive, also it cannot take in loads. This last problem will arise because the floor boards or the floor sheet is subjected to deflection, since the boards or sheet only rest on the joists. This may cause damage to the floor if it is used for other activities than athetics, e.g. for exhibitions etc. High point loads may then occur due to driving with trucks, and the like. Other high point loads may occur due to movable tribunes, and the like.

It is an object of the present invention to provide a sports floor which will give way evenly and sufficiently, has a small structural height, is inexpensive, can take high point loads, and may be laid in a simple and inexpensive manner. According to the invention this is achieved by the aid of a resilient sports floor of the kind comprising an upper layer, which is designed to be a coherent sheet, consisting of boards, preferably laminated parquet boards, which rest on a rigid sub-floor, e.g. a concrete sole, by the aid of resilient means which means are provided in recesses in the underside of the sports floor. Said resilient means are intended to be urged into the recesses in case of high loads, so that they are relieved due to the fact that the underside of the floor is in direct contact with the sub-floor. The floor is characterized by the fact that in each board of the top layer there are recesses in the shape of mutually parallel grooves in the entire length of the board, in which grooves strips of a resilient material, e.g. of natural or synthetic rubber or a porous, springy plastic material, with a larger thickness than the depth of the recesses, are inserted, so that the lower portion of the stips projects below the underside of the layer, and that the free surface of the strips is provided directly against the rigid sub-floor.

By the aid of the invention good springiness and a long life of the floor is achieved. This is due to the fact that only a limited area of the resilient material is pressed down at a given load. Another essential advantage is that the resilient material is protected against excessive loads because the strips of resilient material will be pressed into the grooves and the rigid layer will then rest with its underside against the sub-floor. Consequently, there is a controlled compression of the resilient material, e.g. 50%. The floor can, thus, take very high loads from lift-trucks, cars, transportable tribunes, and the like without the resilient material being excessively loaded and receiving lasting damage.

Certain athletic activities are especially demanding as regards a resilient sports floor. This may, e.g. be the case with light athletics. A common resilient sports floor may then appear to be too rigid, since an athlete reaching the floor with relatively stiff legs, may bring the floor into contact with the sub-floor due to complete compression of the resilient strips. This problem is solved by the aid of the features appearing from claim 2.

Experiments showed that the following advantages are achieved by the aid of the floor according to the invention:

1. It gives way evenly
2. It gives way in an advantageously adapted manner
3. Its structural height is low
4. It is inexpensive
5. It can take high loads
6. Laying is easy.

If lamellar parquet is used in the relatively rigid top layer, special advantages are achieved by the invention. The parquet has very good properties as regards usage and laying is easy. The product is completely prefabricated, it is very stable as regards dimensions, and it can be laid in a resilient manner on a pre-screeded floor. Another essential advantage is that in case of renovation of an existing floor it is possible to lay the floor according to the invention on the existing floor, provided that the latter is plane. Its low structural height ensures that transition regions to doors, and the like are problem-free.

It is also possible to choose a point-resilient floor, which is very suitable for athletics, e.g. in a sports hall and to lay a floor according to the invention, consisting of manageable elements of, e.g. 1–2 $m^2$, e.g. for ball games or other activities where demands for the floor to give way are high.

Figure 2:
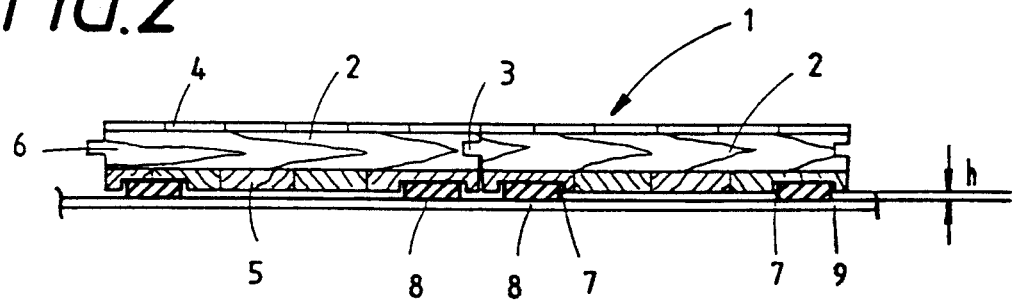
Figure 3:
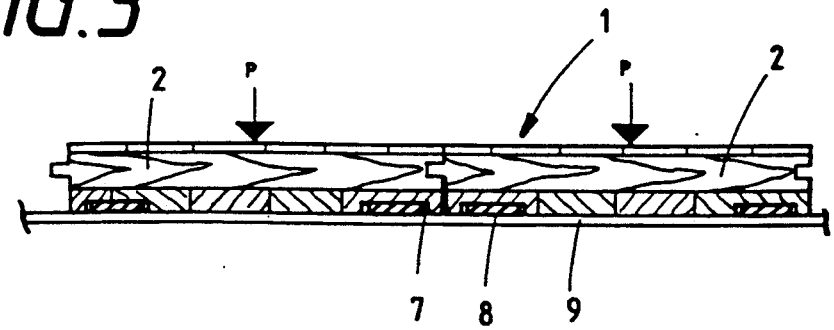
Figure 4:
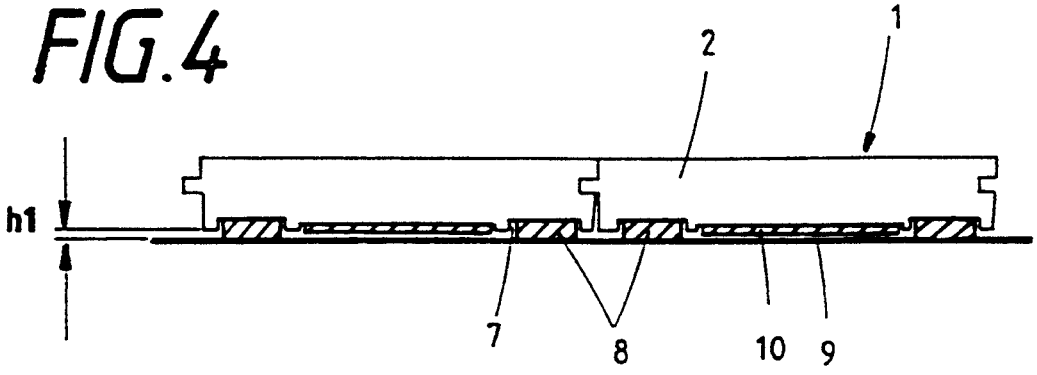
Figure 5:
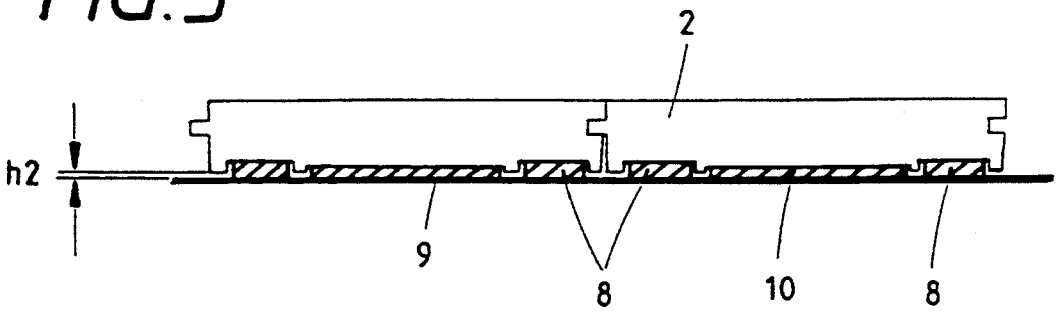
Figure 6:
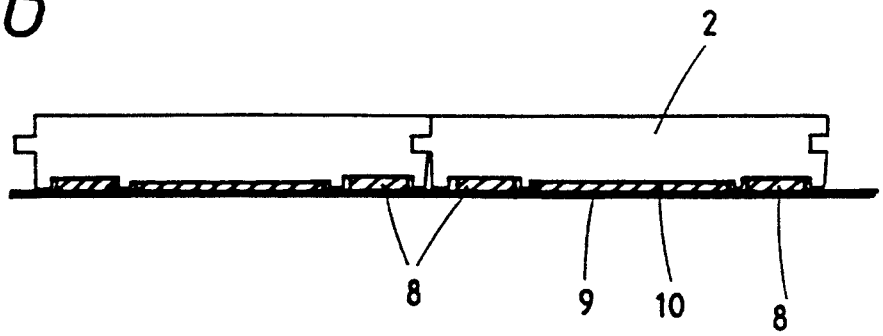

The invention will be disclosed in more detail below with reference to the drawing, in which FIG. 1 as mentioned above, shows a known embodiment of a surface-resilient sports floor, FIG. 2 shows a section of an embodiment of a floor according to the invention in a non-loaded state, and FIG. 3 shows the floor of FIG. 2, but in a loaded state, FIG. 4 shows a modification of the floor according to the invention in a non-loaded state, FIG. 5 shows the floor of FIG. 4 in a slightly loaded or normally loaded state, and FIG. 6 shows the floor according to FIGS. 4 and 5 in a highly loaded state.

The relatively rigid top layer 1 of the floor consists of a lamellar parquet comprising glued together lamellar parquet blocks or boards 2. The boards are connected by a tongue and groove connection 3, both on the longitudinal and the short sides. The lamellar parquet consists of a top layer 4 of hardwood, e.g. oak, a bottom layer 5 of a less expense wood, e.g. white-wood, extending in the same direction as does the top layer, and an intermediate blocking layer 6, which also consists of a less expensive wood. This structure proved to be very well suited for sports floors. Laying these boards may be readily and rapidly done, since they are very stable as regards dimensions and may easily be joined. In the underside of the boards parallel grooves are cut in the longitudinal direction of the boards. In said grooves strips 8 of a springy resilient material, e.g. rubber or plastic is placed. The thickness of the resilient strips 8 is approximately twice the depth of the grooves, so that the rigid sheet formed by boards 2 will lie at a distance h above the rigid sub-floor 9 in case of a non-loaded floor.

As will appear from FIG. 3, the rigid top layer 1 will be urged downwards in the direction of arrow P in case of a high load, and the underlying resilient strips will be compressed and received in grooves 7, so that the underside of the parquet will lie in contact with the rigid sub-floor 9. In this manner any crushing of the resilient intermediate layer between the relatively rigid top layer and the rigid sub-floor is avoided.

In addition to the parallel grooves 7 in the longitudinal direction of the boards 2, a solution is possible with parallel grooves extending across grooves 7.

FIGS. 4–6 show a further development of the invention. In addition to strips 8 of a springy, resilient material a further resilient material 10 is provided between strips 8 in this embodiment. The extension of this material is several times that of the strips. Material 10, which may e. g. consist of a foamed plastic material, is provided to lie with its lower surface at a distance from the support 9 in case of a non-loaded floor. This may be arranged as shown in the embodiment, by having material strip 10 inserted in the underside of each parquet board 2. As will appear from FIG. 4, the boards are placed at a distance h, from the support 9 in a non-loaded state. In case of normal use of the floor, strips 8 will be compressed, and when the boards are loaded by a force $P_2$ they will be urged down so that the distance from support 9 is reduced to distance $h_2$ in FIG. 5. If the floor is subjected to an uncommonly high force $P_3$, strips 8 will be further compressed, and in addition the resilient material 10 will function by being compressed. In the case of FIG. 6, force $P_3$ was so high that board 2 is pressed with its underside all the way down against support 9. In the embodiment $h_1$ is 3 mm. With a normal load, FIG. 5, board 2 is urged 2 mm down towards the support, so that height $h_2$ is 1 mm. The resilient material is, thus, compressed 1 mm before the underside of the board rests on the support. In the shown embodiment material strips 8 are dimensioned to be compressed 50% when board 2 is in contact with the support 9 with its underside. The same is also true of resilient material 10. No crushing pressure will, thus, be exerted on strips 8 or material 10.

The embodiment according to FIGS. 4–6 will solve the problems with a resilient or yielding floor which is subjected to especially high loads, e.g. In case of light athletics. If a relatively heavy, sturdy gymnast comes down on the floor with relatively stiff legs, the floor will be made to contact the support due to the resilient strips 8 being completely compressed. By the aid of the intermediate, additional resilient material 10, which lies at a certain distance from the support, progressive springiness is achieved, because the strips must be compressed at first, until the further resilient material 10 will contact the support. In stead of providing the further resilient material 10 between strips 8 approximately the same effect may be achieved by providing an entire mat of resilient material on top of the support and arranging the embodiment according to FIGS. 2 and 3 on top of the coating.

Having described my invention, I claim:

1. A resilient floor for installation over a sub-floor comprising:

a top layer having an underside and comprised of a plurality of boards which engage each other to form a coherent sheet, each of said boards having first and second parallel recesses, said sheet defining spaced apart recessed in the underside each of a given width and depth;

a resilient strip in each recess having a lesser width and a greater height than the recess width and depth so that the resilient strip supports said top layer on said sub-floor when no load is applied to said top layer, whereby the application of a load on the top layer compresses said resilient strips and said strips thereby resiliently support the top layer on the sub-floor until the load is sufficiently large to compress the strips so that their height equals said depth of the recess and their width is still less than said recess width when the underside of said top layer contacts said subfloor.

2. A resilient floor for installation over a sub-floor comprising:

a top layer having an underside and comprised of a plurality of boards which engage each other to form a coherent sheet, said sheet defining spaced apart recesses in the underside each of a given width and depth;

groove means on the underside of said sheet and extending parallel to said recesses;

a resilient strip in each recess having a lesser width and a greater height than the recess width and depth so that the resilient strip supports said top layer on said sub-floor when no load is applied to said top layer, whereby the application of a load on the top layer compresses said resilient strips and said strips thereby resiliently support the top layer on the sub-floor until the load is sufficiently large to compress the strips so that their height equals said depth of the recess and their width is still less than said recess width when the underside of said top layer contacts said subfloor; and a further resilient strip lying in said groove means, wherein said further resilient strip has a height selected so that it is spaced from said sub-floor when no load is applied to said top layer; whereby the application of a given load to said top layer causes a sufficient compression of the further resilient strip that the further resilient strip contacts the sub-floor.

* * * * *